US005803545A

United States Patent [19]

Guguin

[11] Patent Number: 5,803,545

[45] Date of Patent: Sep. 8, 1998

[54] CHAIR, ESPECIALLY A CHAIR FOR THE HANDICAPPED

[75] Inventor: Pascal Guguin, Auray, France

[73] Assignee: Le Couviour Mobilier spécialisé santé, Pluvigner, France

[21] Appl. No.: 769,221

[22] Filed: Dec. 18, 1996

[30] Foreign Application Priority Data

Dec. 18, 1995 [EP] European Pat. Off. ..... 95 119 928

[51] Int. Cl.[6] ..... A47C 1/02; A61G 15/06

[52] U.S. Cl. ..... 297/316; 297/330; 297/DIG. 10

[58] Field of Search ..... 297/316, 330, 297/344.16, 83, DIG. 10

[56] References Cited

U.S. PATENT DOCUMENTS

| | | | |
|---|---|---|---|
| 3,479,087 | 11/1969 | Burke . | |
| 4,007,960 | 2/1977 | Gaffney | 297/330 X |
| 4,054,319 | 10/1977 | Fogg, Jr. et al. | 297/330 X |
| 4,390,076 | 6/1983 | Wier et al. | 297/330 X |
| 4,407,543 | 10/1983 | Mashuda | 297/330 |
| 4,552,404 | 11/1985 | Congleton . | |
| 4,752,100 | 6/1988 | Lemaire | 297/330 |
| 4,809,804 | 3/1989 | Houston et al. | 297/330 X |
| 4,938,533 | 7/1990 | Thielois . | |
| 4,946,222 | 8/1990 | Matson . | |
| 5,011,224 | 4/1991 | Paul . | |
| 5,094,508 | 3/1992 | Bathrick et al. . | |
| 5,098,158 | 3/1992 | Palarski . | |
| 5,203,610 | 4/1993 | Miller | 297/344.16 |
| 5,265,935 | 11/1993 | Greisler et al. | 297/330 X |
| 5,314,238 | 5/1994 | Komoroski et al. | 297/330 X |
| 5,316,370 | 5/1994 | Newman . | |
| 5,346,280 | 9/1994 | Deumite | 297/DIG. 10 X |
| 5,520,439 | 5/1996 | Blount | 297/330 |
| 5,556,121 | 9/1996 | Pillot | 297/DIG. 10 X |

FOREIGN PATENT DOCUMENTS

| | | |
|---|---|---|
| 2 519 861 | 1/1982 | France . |
| 2 663 218 A1 | 12/1991 | France . |
| 2 677 237 A1 | 12/1992 | France . |
| 41 22 375 A1 | 5/1992 | Germany . |
| 44 41 411 A1 | 5/1995 | Germany . |

*Primary Examiner*—Peter M. Cuomo
*Assistant Examiner*—Rodney B. White
*Attorney, Agent, or Firm*—Antonelli, Terry, Stout & Kraus, LLP

[57] ABSTRACT

Disclosed herein is a chair, especially a chair for the handicapped, in which the backrest and seat are jointly angularly adjustable by only one motor, with the motor and a gas spring being articulated on only one movable pivot axis. This results in a very simple and compact design that has few individual parts.

21 Claims, 2 Drawing Sheets

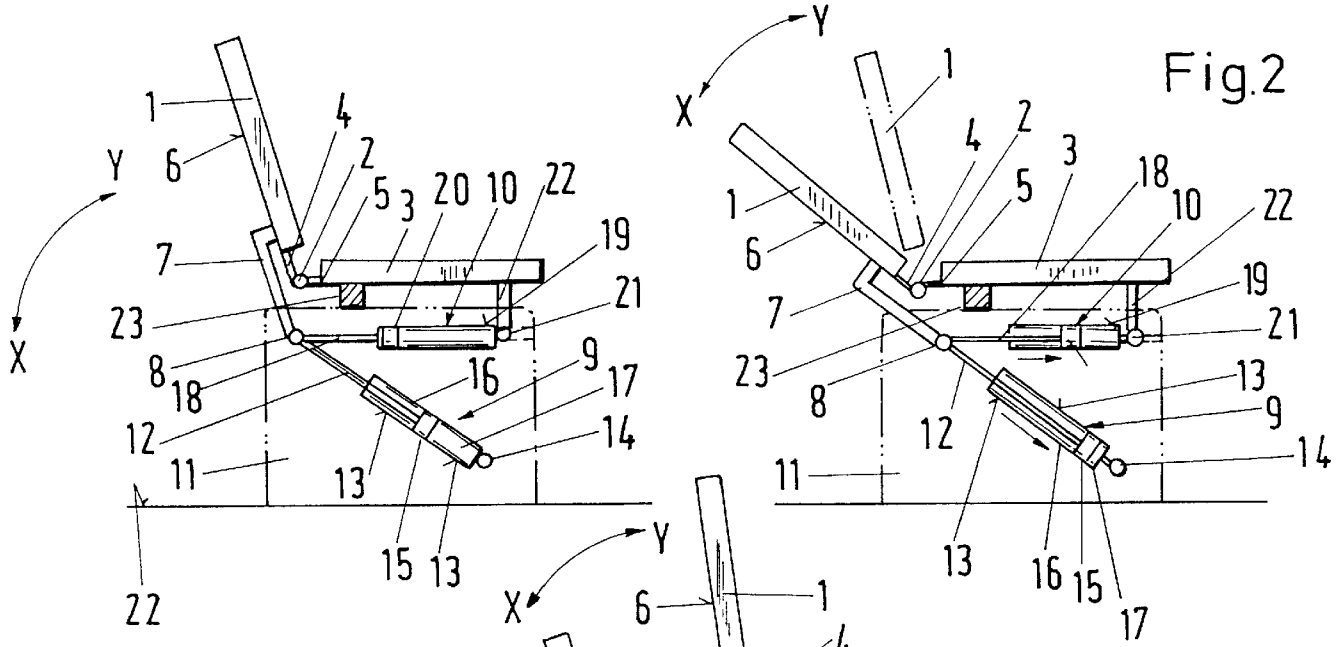
Fig. 1
Fig. 2
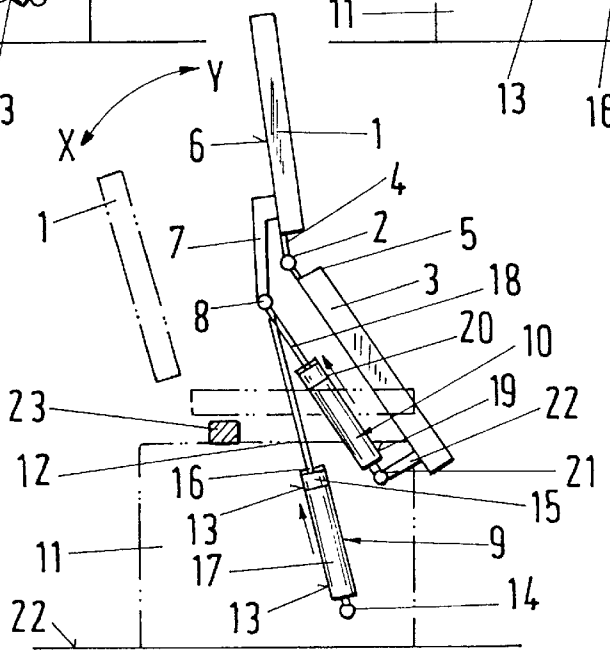
Fig. 3

CHAIR, ESPECIALLY A CHAIR FOR THE HANDICAPPED

BACKGROUND OF THE INVENTION

The invention relates to a chair, especially a chair for the handicapped with a backrest, a seat, and a retaining structure on which the backrest and seat are mounted.

Elderly and sick persons often experience difficulty in assuming a desired seated position or in getting up from the chair again from a seated position without assistance from others.

It is already known from U.S. Pat. No. 3,479,087 to provide chairs or toilet seats with inflatable tubes in order to bring the seat, for example a toilet seat, into a position in which it is at an acute angle to the horizontal, thus making it easy for the handicapped or feeble person to rise.

DE-OS 44 41 411 relates to a chair having a motorized linear actuating drive mechanism with a guide spindle nut that is linearly movable when a motor-driven spindle rotates, in order optionally to actuate a lifting and pivoting rod mechanism, thereby producing a lifting and pivoting movement of the chair when the motor is operated in a first direction. By rotating the spindle in a second, opposite direction, the chair is lowered into the normal sitting position. With continued rotation in the second direction, a first cam block, pivotably mounted on the guide spindle nut, is brought into engagement with a first follower unit to cause the leg support unit to extend. Further rotation in the second direction causes a second cam block pivotably mounted on the guide spindle nut to engage a second follower unit to produce a tilting movement of the chair. These successive operations of the leg support unit and the tilting rod are independent and can be disabled in simple fashion to eliminate one of these features if desired. This design is very expensive and cumbersome, and has only a limited range of application.

A chair is known from DE-OS 41 223 75 that has a motorized linear actuating drive mechanism having a modified nut or "cam guide" that is linearly movable by rotation of a spindle in order to actuate optionally a lifting and pivoting rod mechanism, thereby producing a lifting and forward-pivoting movement of the chair when the motor is operated in a first direction. By rotating the spindle in a second opposite direction, the chair can be lowered into the normal sitting position. Continued rotation in the second direction causes subsequent extension of a leg support unit that follows a tilting movement of the chair. These successive functions of the leg support unit and of the tilting rod are independent and can be disabled in simple fashion in order to eliminate one of these features when desired. This design is also complicated and is consequently expensive. It can only be used with a high degree of comfort in very expensive reclining lounge chairs.

A portable seat support aid is already known from U.S. Pat. No. 5,316,370 that is also intended to assist a handicapped, sick, or feeble person in getting up from a chair. It is a cushion-type structure that is placed on the chair itself and is intended to lift the person in such fashion that they assume at least a bent posture. Compression springs are used that are designed to urge the auxiliary cushion in question upward against the weight of the person when they are triggered. The chair obtained as a result is not stable and it appears questionable whether this design has any other area of application whatever since in the final analysis the item of furniture on which the design must be imposed must exhibit a certain degree of stability and there is the danger that the chair will be destroyed, damaged, or at least scratched. A uniform comfortable chair is not achieved as a result.

U.S. Pat. No. 5,098,158 shows a comfortable armchair with a plurality of members with numerous lifting aids and motors as well as springs. This design is used in armchairs of a very costly design and is not intended specifically for handicapped, sick, or feeble persons.

U.S. Pat. No. 5,094,508 relates to a chair with a seat that can be raised and lowered and tilted at an acute angle. The individual parts of the chair are composed of numerous levers that are pivotably movable at a plurality of articulation points.

U.S. Pat. No. 5,011,224 also teaches a chair that is intended to assist a person in getting up.

This also applies to the design according to U.S. Pat. No. 4,946,222 for a chair with a seat that can be raised and lowered as well as tilted. The person can be tilted forward onto his feet. Likewise it is also possible to tilt the chair into a reclining position. The design is very costly and comprises numerous links, levers, and pivot axes like those used in particular in very expensive reclining lounge chairs in the higher price categories.

Likewise a type of chair is known from U.S. Pat. No. 4,938,533 that is intended to set the person on his feet.

Finally, U.S. Pat. No. 4,552,404 relates to a chair with a seat that can be raised and lowered like a doctor's chair.

SUMMARY OF THE INVENTION

The goal of the invention is to design a chair of the aforesaid type in such fashion that the simplest design with few components permits adjustment not only to the normal seated position with intermediate positions for the backrest but also to the reclining position (prone position) and the position of the backrest and seat can be adjusted to set handicapped, feeble, or sick persons on their feet by means of the chair itself.

This goal is achieved by the features recited in claim 1.

In the design according to the invention a chair requires only one drive motor and one spring, with the drive motor and spring element having their lengthwise axes intersecting at an acute angle at a point and being coupled with one another at said point by a common pivot axis, while the motor is mounted pivotably at the other end and can move in the vertical plane by means of a pivot axis that is fixed to the retaining structure, and the spring element itself is likewise mounted at a distance from this pivot axis by means of a pivot axis that also runs parallel to the fixed pivot axis of the motor, likewise on the retaining structure. In this manner, only one motor will suffice to pivot the backrest up and down and to move the backrest and the seat, especially into a vertical or approximately vertical position, in order to bring the sick, feeble, or otherwise handicapped person into an upright position. By virtue of this design, the number of levers and especially that of pivot axes and drive motors as well, is reduced to a minimum so that the result is a design that is not only compact but is economical and operates in a problem-free manner.

As it pivots upward, the spring element reinforces the driving force of the motor and even if the power fails, in other words if the motor fails, holds the backrest and the seat in the desired position, in the vertical position for example, so that the parts cannot collapse inadvertently if the motor drive should fail.

Inventive and advantageous embodiments are described in claims 2 to 13.

In the design according to claim 2, the common pivot axis of the motor drive and the spring element are coupled by a lever with the backrest, said lever pivoting the backrest up and down when the drive motor is actuated accordingly.

According to claim 3, the motor is designed as a linear motor.

For this purpose, claims 4 to 6 describe advantageous embodiments depending on the application.

For example, claim 4 describes a spindle motor as a linear motor. The spindle is connected at one end at the common pivot axis with the spring element, while the housing in which the spindle nut is located is mounted to be pivotably movable in the vertical plane at the fixed pivot axis.

In the embodiment according to claim 5, the motor is designed as a piston-cylinder unit charged alternately on both sides by the pressure of a pressure medium, hydraulically for example, with the piston rod extending out of the cylinder and being mounted on a common pivot axis with the spring element while the cylinder is mounted at its opposite end on the fixed pivot axis located on the retaining structure.

Claim 6 describes an embodiment in which the linear motor is in the form of an electric motor. Here again a portion of the cylindrical housing is extended outward and connected pivotably to move in the vertical plane on the pivot axis that is common to the spring element.

According to claim 7, the spring element is designed as a gas compression spring that reinforces the lifting movement of the motor to produce a fully vertical position of the backrest and seat.

Claim 8 describes another advantageous embodiment.

In the embodiment according to claim 9 the retaining structure is equipped on its underside with casters. At least one of the casters, and preferably several casters, can be designed to be firmly brakable in order to prevent the chair from inadvertently rolling away.

The embodiment according to claim 10 has its own drive so that handicapped, elderly, or feeble persons, using a battery-powered drive (e.g., having a battery that can be re-charged) or the like (e.g., a gas engine), can move about unaided in the chair, either in corridors, for example in hospitals, nursing homes, or care facilities, or on the street. If the persons in question want to assume a different sitting position or to stand up, this is accomplished in simple fashion by actuating the motor drive. The simple, sturdy design means that only relatively low investment outlays can be expected, even for chairs equipped with their own drives.

Claims 11 to 13 describe advantageous embodiments.

BRIEF DESCRIPTION OF THE DRAWINGS

The invention is shown partially schematically in the drawing.

FIG. 1 shows a chair in a side view with a backrest pivoted into the sitting position;

FIG. 2 shows the chair shown in FIG. 1 with the backrest pivoted further rearward; and FIG. 3 shows the chair shown in FIGS. 1 and 2 with the backrest and seat pivoted into an approximately vertical position.

DETAILED DESCRIPTION OF THE DRAWINGS

Figure 4:
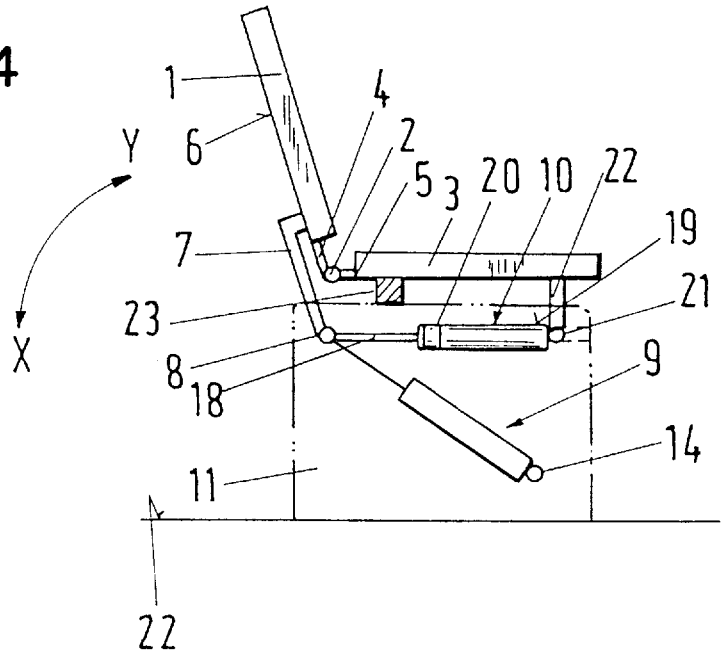
FIG. 4 shows a chair in a side view with a backrest pivoted into the sitting position, and with the motor for moving the backrest and seat shown schematically.

Reference number 1 refers to a backrest that is pivotably movably coupled at pivot axis 2 with a seat 3 by means of steering levers 4 and 5. Steering levers 4 and 5 are made rigid, with steering lever 4 being rigidly connected with backrest 1 and steering lever 5 being rigidly connected with seat 3.

A link 7 is rigidly coupled to back 6, said link being associated at a pivot axis 8 with a motor 9 and a spring element 10. Axis 8 is mounted in a retaining structure 11 that can be the body of the chair, an armchair or wheelchair for example. This retaining structure is schematically shown by dash-dot lines and includes a conventional arrangement of elements such as legs of a chair or wheels of a wheelchair.

Motor 9 in the embodiment shown in FIGS. 1–3 is designed as a piston-cylinder unit. There are also other linear motors, for example spindle drives, electric motors, or the like, that can be used, and are shown schematically in FIG. 4. A piston rod 12 is extended from a cylinder 13. Piston rod 12 is connected pivotably to move in the vertical direction, likewise with the same pivot axis 8 as link 7.

Pivot axis 8 is mounted movably.

A cylinder 13 of the piston-cylinder unit is mounted by an eye in the vertical plane, in other words in directions X and Y, at a pivot axis that is likewise provided in retaining structure 11 but in a fixed position. A piston mounted with a seal in cylinder 13 is indicated by 15. The piston-cylinder unit can be charged alternately on both sides with pressure from a pressure medium, especially hydraulic oil, supplied through lines, not shown, from a pressure medium source, a pump for example, likewise not shown, to one or the other of chambers 16 or 17. This can be accomplished for example by means of a pressure-medium pump located in retaining structure 11 and actuated manually, by the feet of an operator for example.

Spring element 10 is primarily also designed as a piston-cylinder unit, namely as a pretensioned gas compression spring whose piston rod has reference number 18, said rod extending out of a cylinder 19 and likewise being coupled in the vertical direction at pivot axis 8. The midpoints of the pivots (rotational midpoints) of the articulations of piston rods 12 and 18 are therefore mounted orthogonally on the same pivot axis 8. For this purpose, piston rods 12 and 18 can each be provided with an eye for example, said eyes being mounted side by side on pivot axis 8.

A piston of spring element 10 is shown at 20.

Cylinder 19 is mounted pivotably at its end portion facing away from piston rod 8 by means of an eye, not shown, and a pivot axis 21, likewise so that it can move in directions X or Y, in other words, in a vertical plane as well.

Pivot axes 2, 8, 21 and 14 run horizontally and parallel to one another when the surface 22 on which the chair stands is as shown in the drawing.

Pivot axis 21, like pivot axis 14, is mounted in a fixed position on retaining structure 11, while the two pivot axes 2 and 8, corresponding to movement in directions X or Y, change their heights by pivoting, as is clearly evident from a comparison of the individual positions shown in FIGS. 1 to 3.

Seat 3 is also supported by rigid elements 22 on axis 21 and thus on retaining structure 11.

A rigid stop is provided at 23, said stop being mounted on the top of retaining structure 11, with seat 3 resting on said stop in the horizontal position (FIG. 1).

The operation of the chair is as follows:

It is assumed that FIG. 1 shows the starting position and backrest 1 is to be lowered. Then chamber 16 is charged with pressure medium, hydraulic oil for example. This causes piston rod 12 to move into cylinder 13, so that piston 20 also goes further into cylinder 19 at the end of piston rod 18. Backrest 1 moves in direction X (FIG. 2), in other words it assumes a flatter position. Seat 3 remains in its horizontal position as shown in FIG. 1, since it rests on stop 23.

If on the other hand a steeper position of backrest 1 is desired, the other chamber 17 is charged with pressure medium, hydraulic oil in particular. This causes piston 15 to extend and hence piston rod 12 likewise to emerge from cylinder 13.

This causes pivot axis 8 to rise. Backrest 1 also pivots in direction Y. Piston 20 of spring element 10 is pushed out of cylinder 19, with the pretensioned gas reinforcing this movement. Backrest 1 can then be pivoted further, for example into the position shown in FIG. 3. A person seated on the chair is thus practically raised to their feet so that they can walk away. The person can hold onto armrests (not shown) for example. The movement that triggers the pump can be provided by a manual switch, buttons, or the like, that can be integrated into the armrest or other parts of the chair so that backrest 1 and seat 3 can pivot back and forth automatically. As it pivots upward in direction Y, seat 3 also departs from rigid stop 23 and moves in direction Y. Both parts, namely backrest 1 and seat 3, are moved motorwise only by motor 9, with spring element 10 reinforcing this movement. As can be seen, by virtue of the special arrangement of piston rods 12 and 18 but also of link 7, only a few pivot axes are required. A single motor brings about synchronous, simultaneous, and desirable pivoting and adjustment of backrest 1 and seat 3 from an approximately horizontal position into every intermediate position.

The features that can be seen in the abstract, the claims, and the specification as well as the drawing can be important both individually and in any combination for reducing the invention to practice.

List of Reference Numbers

1. Backrest
2. Pivot axis
3. Seat
4. Link lever
5. Link lever
6. Backrest
7. Link
8. Axis
9. Motor, linear motor, piston-cylinder unit, spindle drive, electric motor
10. Spring element, gas compression spring
11. Retaining structure
12. Piston rod
13. Cylinder
14. Pivot axis
15. Piston
16. Chamber
17. Chamber
18. Piston rod
19. Cylinder
20. Piston
21. Pivot axis
22. Surface on which chair stands
23. Stop
X. Pivoting direction
Y. Pivoting direction List of References DE-OS 44 41 411
DE-OS 41 22 375
U.S. Pat. No. 3,479,087
U.S. Pat. No. 5,316,370
U.S. Pat. No. 5,098,158
U.S. Pat. No. 5,094,508
U.S. Pat. No. 5,011,224
U.S. Pat. No. 4,946,222
U.S. Pat. No. 4,938,533
U.S. Pat. No. 4,552,404

What is claimed is:

1. A chair, comprising:

a backrest;

a seat, said seat being connected to said backrest by a first pivot axis;

a retaining structure on which said backrest and said seat are mounted; and a motor and a spring element, each having two ends, each of said motor and said spring element being pivotably mounted at one of the two ends to move in a substantially vertical plane, on respective fixed pivot axes mounted on the retaining structure, and with both said motor and said spring element being pivotably mounted, at the other of the two ends, to a common pivot axis which is connected to said backrest so as to move with said backrest in said substantially vertical plane such that said common pivot axis migrates in said substantially vertical plane during pivoting, with said first pivot axis, fixed pivot axes and common pivot axis extending perpendicular to said substantially vertical plane and parallel to each other.

2. The chair according to claim 1, wherein said first pivot axis, located between said backrest and said seat, is coupled rigidly firstly by a first rigid linking lever with said backrest and secondly by a second rigid linking lever with said seat.

3. The chair according to claim 1 or claim 2, wherein said motor is a linear motor.

4. The chair according to claim 3, wherein said pressure medium is a hydraulic pressure medium.

5. The chair according to claim 3, wherein said linear motor is a spindle drive motor.

6. The chair according to claim 3, wherein said linear motor includes a cylinder having a piston therein, the cylinder having two chambers respectively at two opposed sides of the piston, such that the two chambers can be charged alternately on the two opposed sides with pressure from a pressure medium.

7. The chair according to claim 3, wherein said spring element is a gas compression spring.

8. The chair according to claim 3, wherein said linear motor is an electric motor.

9. The chair according to claim 8, wherein said spring element is a gas compression spring.

10. The chair according to claim 1, wherein said spring element is a gas compression spring.

11. The chair according to claim 1, wherein both said motor and said spring element are coupled in pivotably movable fashion by piston rods each with said common pivot axis, while cylinders of said motor and a cylinder of the gas compression spring are coupled in a pivotably movable fashion with the respective associated fixed pivot axes.

12. The chair according to claim 1, wherein said retaining structure is provided with rollers.

13. The chair according to claim 1, wherein the chair is provided with a drive motor to drive wheels or rollers thereof.

14. The chair according to claim 13, wherein the drive motor comprises a battery that can be charged.

15. The chair according to claim 13, wherein the drive motor is a gasoline engine.

16. The chair according to claim 1, wherein the motor and the spring element respectively extend in first and second directions between said common pivot axis and respective fixed pivot axes, and wherein said first direction and said second direction form an acute angle therebetween.

17. The chair according to claim 16, wherein said fixed pivot axis to which the spring element is mounted is connected to the seat, and said common pivot axis is connected to the backrest.

18. The chair according to claim 1, wherein said fixed pivot axis to which the spring element is mounted is connected to the seat, and said common pivot axis is connected to the backrest.

19. The chair according to claim 1, wherein the spring element is mounted under pretension when the seat of the chair is in a sitting position with the backrest upright.

20. The chair according to claim 1, further comprising a rigid stop which supports the seat.

21. The chair according to claim 1, wherein said seat is substantially horizontal when said seat of said chair is in a sitting position.

* * * * *